US006140924A

United States Patent [19]

Chia et al.

[11] Patent Number: 6,140,924

[45] Date of Patent: Oct. 31, 2000

[54] RECTIFYING ANTENNA CIRCUIT

[75] Inventors: Michael Yan Wah Chia; Jurianto Joe; Ashok Kumar Marath, all of Singapore, Singapore

[73] Assignee: Nat'l. Univ. of Singapore, Singapore

[21] Appl. No.: 09/225,188

[22] Filed: Jan. 5, 1999

[30] Foreign Application Priority Data

Feb. 7, 1998 [SG] Singapore ..... 9800268-6

[51] Int. Cl.[7] ..... G08B 13/14

[52] U.S. Cl. ..... 340/572.5; 340/572.7; 323/220

[58] Field of Search ..... 340/572.5, 572.7; 342/42, 44, 51; 323/220, 229, 232, 233

[56] References Cited

U.S. PATENT DOCUMENTS

| | | | |
|---|---|---|---|
| 3,713,148 | 1/1973 | Cardullo et al. | 342/42 |
| 3,728,630 | 4/1973 | Strenglein | 342/187 |
| 4,642,558 | 2/1987 | Batchman et al. | 324/72.5 |
| 4,853,705 | 8/1989 | Landt | 343/803 |
| 5,731,691 | 3/1998 | Noto | 323/220 |

*Primary Examiner*—Thomas Mullen
*Attorney, Agent, or Firm*—Ipsolon, LLP

[57] ABSTRACT

A rectifying antenna circuit for a passive RF transponder comprising a series resonant circuit of an antenna, a voltage rectifier circuit including a diode and a capacitance shunting the diode, the capacitance providing a primary voltage amplification role and the diode providing a rectification and a voltage amplification role.

12 Claims, 3 Drawing Sheets

Fig. 1
DIODE EQUIVALENT CIRCUIT
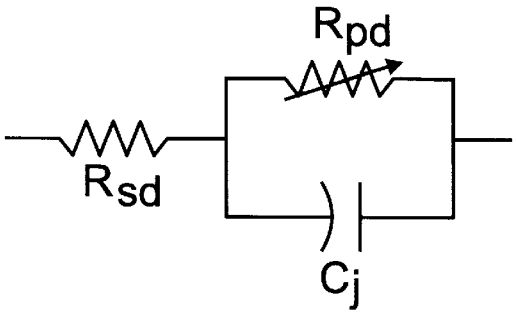
Fig. 2
S-PARAMETER DIODE MODEL
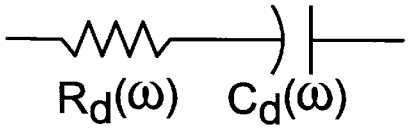
Fig. 3 MICROSTRIP MATCHING RECTENNA CIRCUIT USING EXTERNAL CAPACITOR
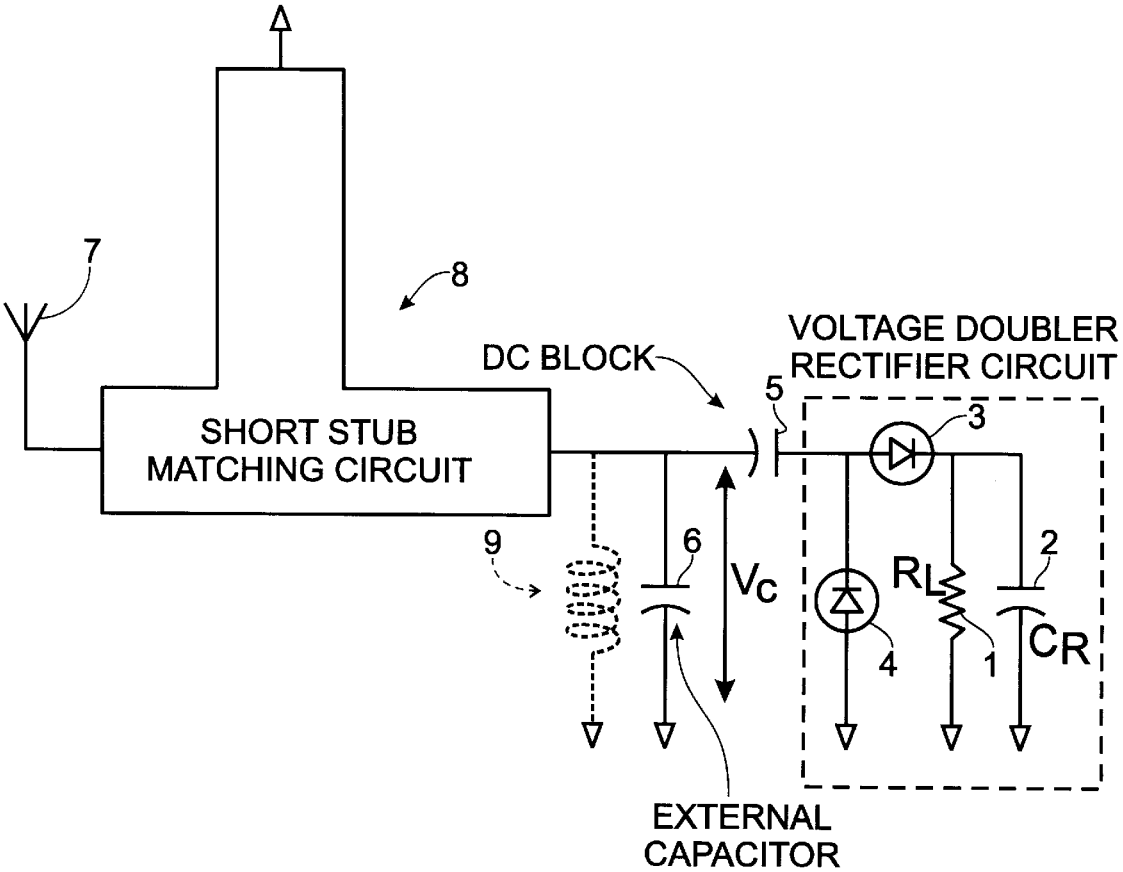

DC OUTPUT VOLTAGE FOR THE RECTENNA CIRCUIT
SOLID LINE - SIMULATION, DASHED LINE - MEASURED

DC VOLTAGE AND THE VOLTAGE ACROSS THE MICROSTRIP
THAT REPLACES A DISCRETE EXTERNAL CAPACITOR

RECTIFYING ANTENNA CIRCUIT

This invention relates to a rectifying antenna circuit for passive RF transponders.

BACKGROUND OF THE INVENTION

Rectifying antennas (rectennas) for high power signals (≧10 dBm) are used in satellite and radio relay systems. A rectifying antenna circuit achieves 80% to 90% RF to DC conversion efficiencies under these conditions. In contrast, rectifying antenna circuits for low power signals (≦0 dBm), achieve much lower efficiencies. However, such low power signals are useful in passive RF transponder applications such as in RF identification (RFID) where the voltage required at the RF transponder is in the region of one volt and the current is on the order of tens of microamperes ($\mu$A). Typically, RFID systems consist of a reader which sends an RF interrogation signal to a transponder, the transponder receiving the signal and transmitting a response signal containing the identification code of the transponder back to the reader so that the reader can identify the transponder. The RF energy received by a passive RF transponder is converted to DC power to drive the base band circuitry of the transponder to generate the response signal.

In conventional low power rectenna circuitry designs, to provide maximum power rectification, the impedance of zero bias Schottky diodes are matched to the receiving antenna. The matching circuit is achieved by intentionally selecting an antenna which has a reactance which resonates with the junction capacitance in the Schottky diodes or using inductance elements to match the impedance of the antenna with that of the Schottky diodes (see European Patent publication numbers EP-0 344 885 and EP-0 458 821). These methods of matching constrain the types of antennas and Schottky diodes used. Further, these approaches rely predominantly on the junction capacitance of the rectifying diodes within the voltage rectification circuit to achieve the voltage magnification. Since the antenna and diode are fixed, the resonant frequency cannot be tuned without redesigning the circuit or the antenna. Mis-matching—as a result of the tolerances inherent in the components in the printed circuit board of the transponder—results in frequency detuning which can cause an undesirable reduction in the optimised range of the passive RF transponder.

Another problem is that the capacitance of the diode which is dynamic in nature will be highly dependent upon the power level of the rectifying antenna circuitry and hence the current through the rectifying antenna circuitry. The resistance of the shunting Schottky diode is also dynamic being dependent on the current and will change the effective impedance of the Schottky diode depending upon the current level. These variations in the reactance of the Schottky diode can change the resonant frequency of the passive RF transponder and hence reduce available voltage magnification at a given frequency.

The present invention seeks to overcome the above problems by providing an improved voltage magnification circuit for passive RF transponders.

Accordingly, one aspect of the present invention provides a rectifying antenna circuit for a passive RF transponder comprising a series resonant circuit consisting of: an antenna; a voltage rectifier circuit including a diode; and a capacitance shunting the diode, the capacitance providing primarily a voltage amplification role and the diode providing primarily a rectification role.

In order that the present invention may be more readily understood, embodiments thereof will now be described, by way of example, with reference to the accompanying drawings:

BRIEF DESCRIPTION OF THE DRAWINGS

FIG. 1 is a circuit diagram of a Schottky diode equivalent circuit;

FIG. 2 is a schematic representation of a model of the circuit of FIG. 1;

FIG. 3 is a schematic circuit diagram of a rectifying antenna circuit embodying the present invention;

DESCRIPTION OF THE PREFERRED EMBODIMENTS

Figure 4:
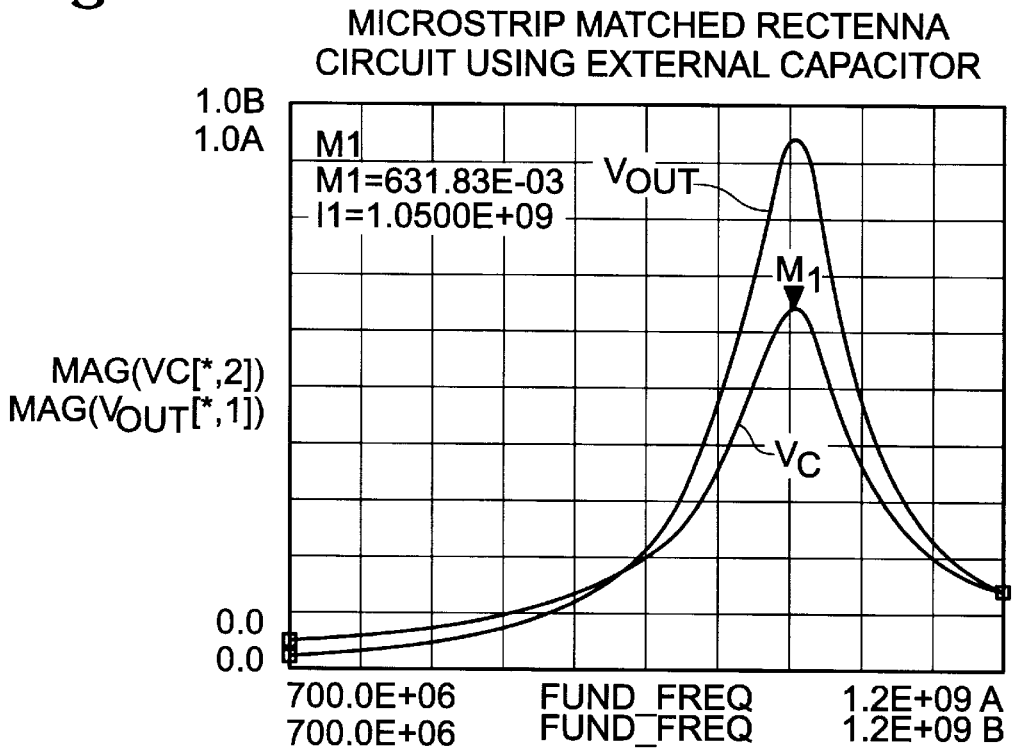
FIG. 4 is a graph showing the simulated relationship between the voltage outputs of the circuit of FIG. 3 according to a first embodiment of the present invention.

Referring to FIG. 1, in RF design, a Schottky diode can be modelled as a combination of a resistance and a capacitance and, more particularly, as a first resistance $R_{pd}$ in parallel with a capacitance $C_j$, which parallel arrangement is shunted by a second resistance $R_{sd}$. The first resistance $R_{pd}$ is the resistance of the barrier at the rectifying contact of the Schottky diode and varies with the current flowing through the rectifying contact. This resistance is large when the Schottky diode is backward-biased and small when the Schottky diode is forward-biased. As the forward-biased current increases, the resistance $R_{pd}$ decreases. The second resistance $R_{sd}$ is the parasitic series resistance of the Schottky diode and comprises the sum of the bond wire and leadframe resistances. The RF energy dissipated by this resistance is dissipated as heat. The capacitance $C_j$ is the junction capacitance which arises from the storage of charge in the boundary layer of the Schottky diode. The equivalent circuit shown in FIG. 1 can be simplified to that shown in FIG. 2 where $R_d(\omega)$ and $C_d(\omega)$ are related to the components shown in FIG. 1 by the following relationships:

$$R_d(\omega) = R_{sd} + \frac{R_{pd}}{1 + \omega^2 R_{pd}^2 C_j^2} \tag{1}$$

$$C_d(\omega) = C_j\left(1 + \frac{1}{\omega^2 R_{pd}^2 C_j^2}\right) \tag{2}$$

where $\omega$ is the resonant frequency, the limits being $R_{pd} \rightarrow \infty$, $C_d(\omega) \rightarrow C_j$ and $R_d(\omega) \rightarrow R_{sd}$.

Referring to FIG. 3, a rectifying antenna circuit embodying the present invention is shown which comprises a voltage doubler rectifier circuit comprising a load resistance 1 and a filtering capacitor 2 connected in parallel to one another and shunted by a pair of Schottky diodes 3,4 and a series capacitor 5. The voltage doubler rectifier circuit is connected in parallel with an external capacitor 6. The capacitor 6 is termed an external capacitor 6 since it is connected external of and across the voltage rectifier circuit. An antenna 7 is connected to the external capacitor 6 and voltage doubler rectifier circuit through a short stub matching circuit 8. It has been shown that as $R_d(\omega)$ increases with the diode current, adding an optimised external capacitor 6 gives comparable or better voltage magnification than known circuitry (such as that disclosed in EP-0 344 885 and EP-0 458 821) at higher diode currents (on the order of tens of microamps). Such higher diode currents are required to drive the baseband circuits within passive RF transponders so as to perform more and/or faster processing of signals.

In the circuitry shown in FIG. 3, the external capacitor 6 and the shunted load of the diodes 3,4 are matched with a single short stub microstrip transmission line 8. This provides maximum power transfer to the external capacitor 6 which is then used as an AC source to be rectified by the Schottky diodes 3,4 to a DC signal. The external capacitor 6 can be in the form of a discrete component or a microstrip. If the external capacitor 6 has a small capacitance, in the order of 1 pF, then microstrip is used instead of a discrete component so as to save costs. The microstrip capacitance can be changed by varying the dimensions of the microstrip if the design is required to be de-tuned to operate at a particular frequency. If the capacitance of the external capacitor 6 is large, then it is preferable to use a discrete component other than microstrip as the dimensions of the necessary microstrip would be too large to be practical for use in a passive RF transponder. To provide such a rectifying antenna circuit with a retuning capability, the external capacitor 6 in the form of a discrete component would be replaced by a variable capacitor.

In a first example of the embodiment shown in FIG. 3, the following values listed in the Table below are attributed to the respective components of the circuit.

TABLE

| COMPONENT | VALUE |
|---|---|
| Capacitor $C_R$ | 1000 pF |
| Load Resistor $R_L$ | 33 kΩ |
| Schottky diodes 3,4 | HSMS 2852 |
| Series capacitor | 1000 pF |
| External Capacitor | 1 pF |
| PCB dielectric constant | 3 |

Referring to FIG. 4, the voltage output across the external capacitor 6 ($V_c$) and the DC voltage output ($V_{out}$) are shown. This simulation assumes a signal input power of −10 dBm received at the antenna 7. The equivalent input voltage at this power level for 50 Ω microstrip line is 100 mV. The external capacitor 6 provides a primarily voltage amplification role and the two diodes in the voltage doubler rectifier circuit serve mainly to rectify the input voltage from AC to DC although they may also have a small role in voltage magnification. This arrangement produces a voltage output ($V_c$) across the external capacitor 6 of in the region of 0.6 V and a DC output voltage ($V_{out}$) across the load resistor $R_L$ in the region of 0.92 V. The external capacitor 6 thereby provides a magnification of the input voltage by a factor of 9.

Figure 5:
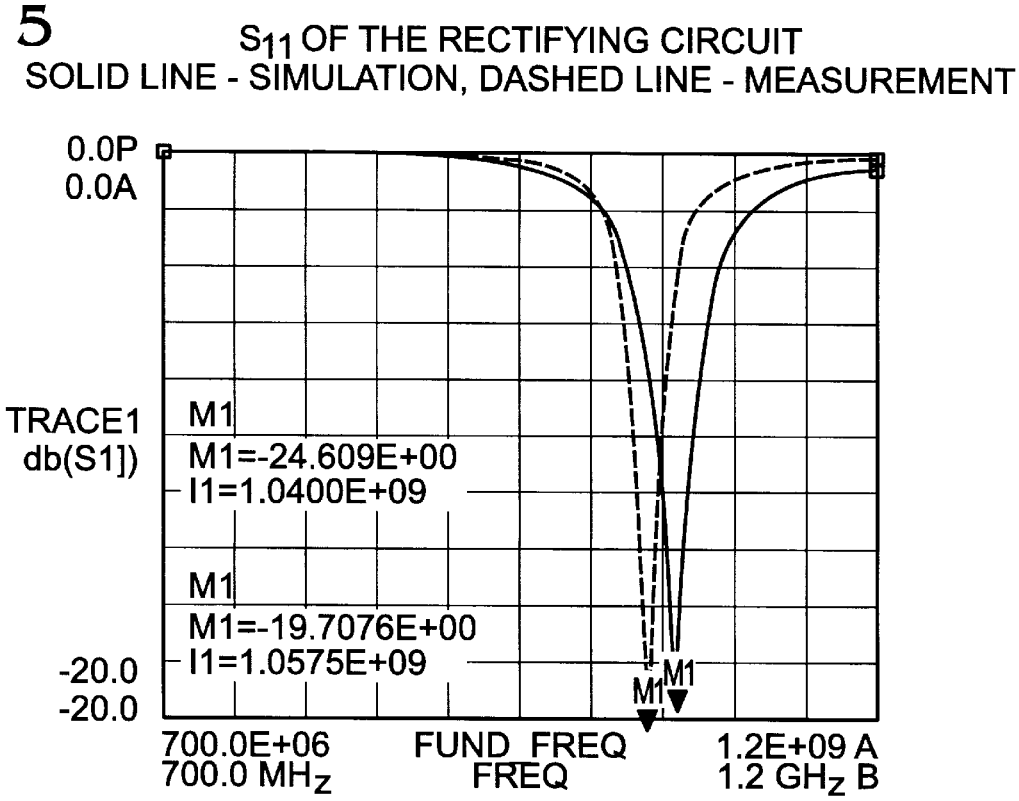
FIG. 5 is a graph showing a simulated and a measured frequency response of a first example of an embodiment of the circuit of FIG. 3.

FIG. 5 illustrates the frequency response of the rectifying antenna circuit. The solid line represents the results of a simulation using the components of the above example and the dashed line represents the results as actually measured.

Figure 6:
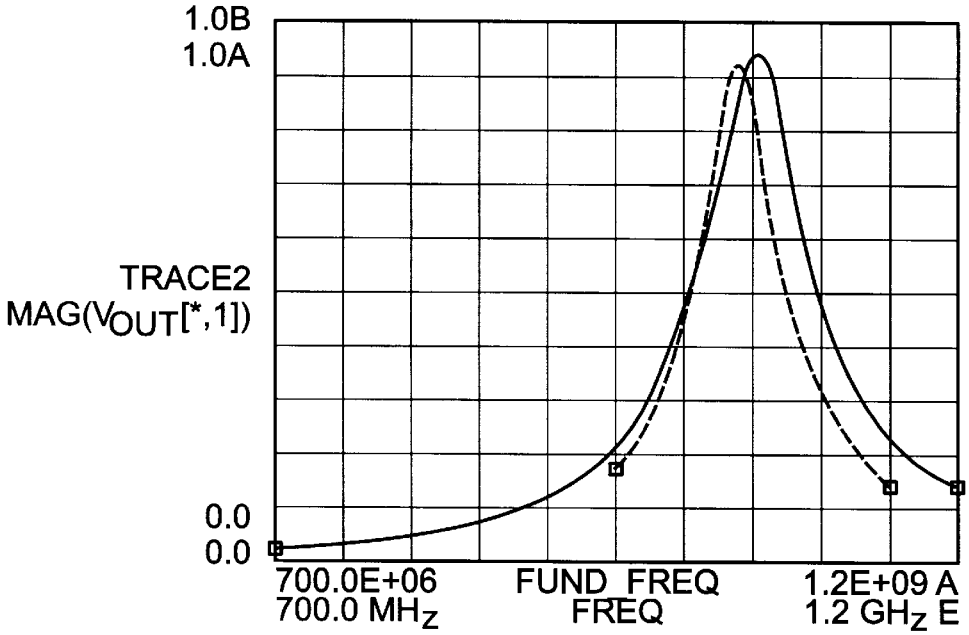
FIG. 6 is a graph showing the comparison between a measured output DC voltage and a simulated output DC voltage of the circuit of FIG. 3.

The frequency response and output voltage measurement results agree well with the simulations. A small percentage frequency shift is observed in both FIGS. 5 and 6. This is attributable to the tolerance of the external capacitor 6 and the single stub length of the short stub matching circuit 8 which is susceptible to error during the PCB processing. A few mils of difference can shift the resonant frequency easily.

The above example of a rectifying antenna circuit provides more than 25% conversion efficiency from the power of the signal received to the output voltage. This is substantially higher than the efficiency achieved by known low power rectifying antenna circuits.

Figure 7:
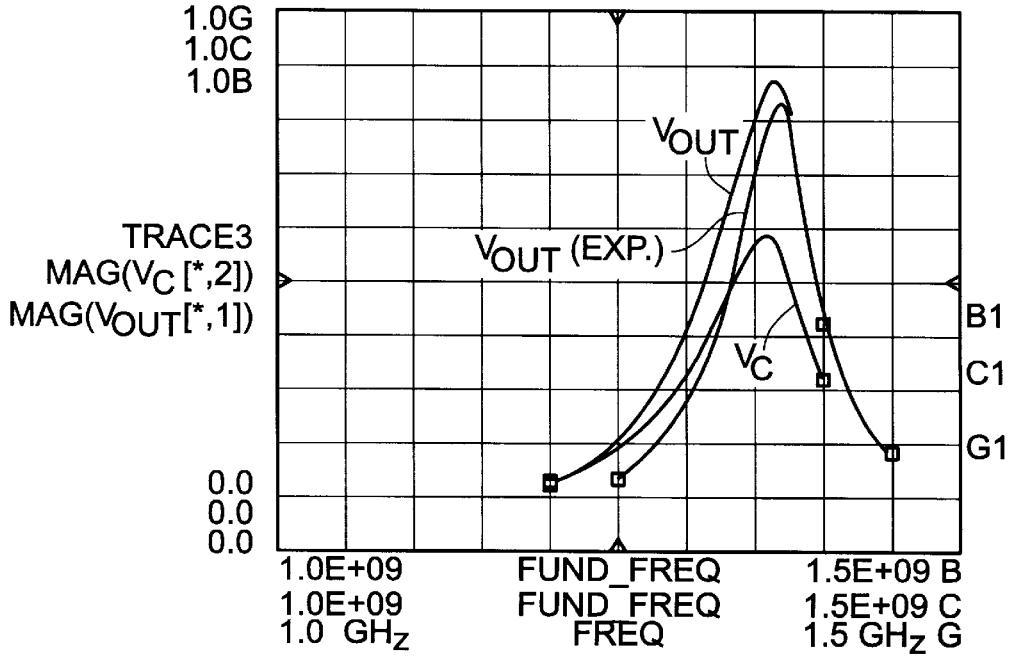
FIG. 7 is a graph illustrating a simulated and a measured voltage output of a second example of the circuit of FIG. 3.

In another example of the rectifying antenna circuit of FIG. 3, the same values for the components identified in the above table were used except the 1 pF external capacitor 6 is replaced with an equivalent microstrip. The advantages of replacing the discrete component of the external capacitor 6 with a microstrip are that of cost-effectiveness (compared to a high accuracy 1 pF discrete capacitor). FIG. 7 illustrates the simulated and measured output voltages for this example of the rectifying antenna circuitry. The simulated $V_{out}$ is identified as Vout and the measured $V_{out}$ is identified as Vout(exp.). The voltage across the external capacitor 6 comprising the microstrip is identified as Vc. As can be seen from the magnitude of the voltage ($V_c$) across the external capacitance 6 it is apparent that the voltage magnification is caused by the microstrip comprising the external capacitor 6, the diodes in the voltage doubler rectifier circuit primarily rectifying the voltage. The measured output voltages are close to those predicted by the simulation ($V_{out}$). The resonant frequency can be tuned by varying the width and length of the microstrip that replaced the external capacitor 6.

The use of the external capacitance has another advantage in that it serves to reduce the capacitive reactance of the overall voltage rectifier circuit. Due to the reduction in the capacitive reactance in the overall voltage rectifier circuit, the rectifying antenna circuit requires a shorter transmission line to provide matching between the antenna 7 and the voltage rectification circuitry. This makes the overall circuitry more compact than would be the case without the use of the external capacitance. For example, the external capacitance can reduce the length of the transmission line of the matching circuit by more than λ/16. This is primarily because the capacitive reactance of the external capacitor is less than that of the diodes within the voltage rectifier circuit.

Whilst the above described examples shunt the diode with a capacitance, it is to be appreciated that similar effects are achieved by using a primarily inductive component (shown in dashed line at 9 in FIG. 3) to shunt the diode instead of the above described primarily capacitive component. Thus, any component having reactance—be it primarily capacitive or inductive—provides the above advantages to rectifying antenna circuits embodying the present invention.

What is claimed is:

1. A rectifying antenna circuit for a passive RF transponder comprising a series resonant circuit consisting of: an antenna; a voltage rectifier circuit including a diode; and a reactance shunting the diode, the reactance providing primarily a voltage amplification role and the diode providing primarily a rectification role.

2. A circuit according to claim 1, wherein the reactance comprises primarily an inductance.

3. A circuit according to claim 1, wherein the reactance comprises primarily a capacitance.

4. A circuit according to claim 3, wherein the capacitance comprises a discrete capacitive component.

5. A circuit according to claim 4, wherein the capacitive component is a variable capacitor, adjustment of the capacitance retuning the resonant frequency of the rectifying antenna circuit.

6. A circuit according to claim 1, wherein the reactance comprises a micro-strip transmission line.

7. A circuit according to claim 6, wherein the reactance of the micro-strip transmission line is adjustable by varying the dimensions of the micro-strip, such adjustment of the reactance retuning the resonant frequency of the rectifying antenna circuit.

8. A circuit according to claim 1, wherein the voltage rectifier circuit includes two diodes.

9. A circuit according to claim 1, wherein the diode comprises a Schottky diode.

10. A circuit according to claim 1, wherein a matching circuit is provided in series between the antenna and the reactance and voltage rectifier circuit.

11. A circuit according to claim 10, wherein the matching circuit is a short stub matching circuit in the form of low-loss micro-strip transmission lines.

12. A passive RF transponder including a rectifying antenna circuit according to claim 1.

* * * * *